United States Patent [19]

Whiteman

[11] Patent Number: 4,527,959

[45] Date of Patent: Jul. 9, 1985

[54] DRILLING FLUID PUMP PROVIDING A UNIFORM, CONTROLLED PRESSURE AND FLOW RATE

[75] Inventor: Marvin E. Whiteman, Boise, Id.

[73] Assignee: Whiteman Manufacturing Company, Boise, Id.

[21] Appl. No.: 493,351

[22] Filed: May 10, 1983

[51] Int. Cl.[3] ..... F04B 9/10

[52] U.S. Cl. ..... 417/342; 417/347; 417/397; 417/446; 417/427; 417/428

[58] Field of Search ..... 417/342, 344, 345, 347, 417/397, 446, 502, 515, 539, 426, 427, 428, 245

[56] References Cited

U.S. PATENT DOCUMENTS

| | | | |
|---|---|---|---|
| Re. 26,820 | 3/1970 | Bennett | 417/342 |
| 71,287 | 11/1867 | Dennison et al. | 417/427 |
| 1,081,784 | 12/1913 | Spohrer | 417/397 X |
| 1,450,901 | 4/1923 | Kollberg | 417/428 X |
| 2,169,703 | 8/1939 | Mason | 417/397 X |
| 2,187,972 | 1/1940 | Hollander | 417/345 |
| 3,135,210 | 6/1964 | English | 417/347 |
| 3,146,721 | 9/1964 | Schwing | 417/342 X |
| 3,162,133 | 12/1964 | Smith . | |
| 3,205,906 | 9/1965 | Wilkinson | 417/342 X |
| 3,459,363 | 8/1969 | Miller | 417/446 |
| 3,650,638 | 3/1972 | Cole | 417/346 |
| 4,174,928 | 11/1979 | Austin | 417/397 |
| 4,350,080 | 9/1982 | Page, Jr. | 417/342 X |

FOREIGN PATENT DOCUMENTS

| | | |
|---|---|---|
| 551683 | 3/1943 | United Kingdom . |
| 1034957 | 6/1966 | United Kingdom . |
| 1406861 | 9/1975 | United Kingdom . |

*Primary Examiner*—Leonard E. Smith
*Attorney, Agent, or Firm*—Pretty, Schroeder, Brueggemann & Clark

[57] ABSTRACT

A pump is provided for circulating drilling fluid and the like into a well during a well drilling process. The pump comprises a pair of double-ended piston assemblies hydraulically reciprocated in opposite directions by a common hydraulic drive arrangement, wherein each piston assembly has a relatively large piston at one end and a relatively small piston at an opposite end. The various pistons reciprocate within appropriately sized cylinders each having a working end with a one-way intake valve through which drilling fluid is drawn from a supply tank and a one-way discharge valve through which drilling fluid is discharged to the well. These intake and discharge valves, or other flow control valves in an alternative form of the invention, can be set appropriately for pumping drilling fluid at a relatively high pressure and low flow rate using only the smaller pistons or for pumping drilling fluid at a comparatively lower pressure and higher flow rate using only the larger pistons, wherein drilling fluid is continuously circulated by the unused pistons through the unused cylinders to maintain fluid flow thereby preventing settling of particulate entrained in the drilling fluid within unused cylinders. Still further, the various valves can be set for pumping drilling fluid at a further reduced pressure and still higher flow rate using the large and small pistons in combination. In other alternative embodiments of the invention, the discharge pressure of the drilling fluid can be intensified by appropriate routing of a portion of the drilling fluid in a manner to assist driving either the large or small pistons.

26 Claims, 9 Drawing Figures

10
3
3
28
20
17
18
16

32
30
28
20

20
30
10
15
14
22
12
18
13
17
16

DRILLING FLUID PUMP PROVIDING A UNIFORM, CONTROLLED PRESSURE AND FLOW RATE

BACKGROUND OF THE INVENTION

This invention relates generally to pumping apparatus particularly of the type commonly referred to as a mud pump for circulating drilling fluid in conjunction with deep well drilling processes, such as the drilling or reworking of oil wells, gas wells, water wells, and the like. More particularly, this invention relates to an improved so-called mud pump having multiple hydraulically driven piston assemblies adapted for delivering drilling fluid to a well at different substantially uniform pressures and flow rates while continuously cycling drilling fluid throughout all pump cylinders during all conditions of operation to prevent settling of particulate or solidification of the drillig fluid within any portion of the pump.

In the well drilling industry, such as original drilling, reaming, or reworking of oil and gas wells, water wells, and the like, a drilling tool is descended into the well and rotatably driven for drilling through earth and rock to appropriately increase the depth or diameter of the well bore. During such drilling processes it is necessary to circulate a drilling fluid into the well typically by flow downwardly through the drilling tool to lubricate the drilling process and to lift particulates soil and rock upwardly from the well through the annular space about the drilling tool. This drilling fluid, which commonly comprises a mixture of water, clays, and chemicals, is normally conveyed to a tank or pit at the surface where the particulate is allowed to settle prior to recirculation of the fluid into the well.

In the past, drilling fluid circulation pumps, commonly referred to as mud pumps, have conventionally comprised crankshaft-driven pumps having reciprocating pistons within cylinders to draw in drilling fluid upon piston retraction followed by piston extension to discharge the flow under pressure through a flow conduit to the well. However, in such pumps, the pistons typically move through relatively short strokes whereby relatively rapid crank shaft rotational speeds are required to develop the substantial fluid pressures required, typically on the order of several thousand psi. Moreover, such crankshaft-driven pumps inherently move the pistons with nonuniform velocities varying widely in accordance with the rotational position of the crankshaft. This velocity variation of the pistons results in nonuniform drilling fluid discharge which can create pulsations in fluid flow lines resulting in damage thereto. Still further, the many moving parts inherently required in crankshaft-driven pumps renders these pumps particularly susceptible to mechanical failures which, in the past, has been avoided only by constructing the pumps from extremely rugged, costly components.

Hydraulically driven piston pumps have been proposed for use in drilling fluid applications. See, for example, U.S. Pat. Nos. 2,169,703 and 3,650,638. While these hydraulically driven drilling fluid pumps overcome some of the nonuniform fluid delivery characteristics of crankshaft-driven piston pumps, hydraulically driven pumps have not been well accepted by the drilling industry. This lack of acceptance is due in part to the relative complexity and cost of previous hydraulic pumps, or alternatively, the inability of such pumps to delivery drilling fluid at different pressures and flow rates which are sometimes required without settling and/or solidification of drilling fluid within portions of the pump.

The present invention overcomes the problems and disadvantages encountered in the art by providing an improved hydraulically driven mud pump particularly designated for delivering drilling fluid at different selected flow rates and pressures wherein the pump is relatively simple in design and operation and further wherein drilling fluid is continuously circulated through all portions of the pump during all modes of operation.

SUMMARY OF THE INVENTION

In accordance with the invention, a drilling fluid pump is provided for supplying drilling fluid at one of several selected pressures and flow rates to a well, such as an oil and gas or water well, during a drilling procedure. The pump comprises a plurality of double-ended piston assemblies each having relatively large and small pistons at opposite ends thereof for reciprocation within appropriately sized cylinders. The double-ended piston assemblies are reciprocated together in opposite directions by a common hydraulic drive arrangement. The cylinders are associated with control valves for coupling the cylinders for drawing-in drilling fluid from a supply tank and for discharging the drilling fluid to a discharge conduit and, during some operating conditions, for coupling selected cylinders to draw in and recycle drilling fluid to the supply tank.

In one preferred form of the invention, two double-ended piston assemblies are provided each with relatively small and relatively large pistons at opposite ends of an elongated piston rod. The piston rods of the two piston assemblies each carry a drive spool within an hydraulic pressure chamber disposed intermediate the associated pair of cylinders. The pressure chambers are connected to an hydraulic pump and fluid return reservoir through a distribution valve which couples the hydraulic fluid under pressure and the return reservoir alternately and respectively to the pressure chambers of one side of the drive spools for reciprocation of the piston assemblies. A pilot hydraulic fluid within the pressure chambers at the opposite sides of the drive spools communicates through a cross-over conduit between the pressure chamber to drive the piston assembly coupled to the return reservoir in an opposite direction to the piston assembly coupled to the hydraulic pump.

The drilling fluid cylinders each include a working end having a one-way intake valve communicating through an intake conduit to a drilling fluid supply tank and a one-way discharge valve communicating through a discharge conduit to the well. The intake valves of the various cylinders are associated with override mechanisms for selectively retaining the intake valves in an open position to permit pump operation at various flow rates and pressures. More particularly, when the intake valves associated with the larger pistons are held open, the larger pistons draw in and recirculate drilling fluid to the supply tank through the open intake valves whereas the smaller pistons draw in drilling fluid for discharge at a relatively high pressure and low flow rate through the discharge conduit to the well. Alternately, when the intake valves associated with the smaller pistons are held open, the smaller pistons recirculate the fluid through the open intake valves to the supply tank whereas the larger pistons pump the drilling fluid through the discharge conduit to the well at a comparatively lower pressure and higher flow rate. When none of the intake valves are held open, the large and small pistons all discharge drilling fluid through the discharge conduit to the well at an overall increased flow rate and relatively lower pressure.

In an alternative form of the invention, the intake valve override mechanisms are omitted and the discharge conduits leading from the large and small pistons are respectively coupled to recycle conduits for returning discharged drilling fluid to the supply tank. Flow control valves installed along the discharge and recycle conduits can be selectively opened or closed, as required, to control the flow rate and pressure of drilling fluid discharged to the well.

In further alternative forms of the invention, pressure intensification may be obtained to further increase the pressure of drilling fluid discharged from the pump for flow to the well. In one form, an intensifier conduit can be coupled between the opposite working ends of each double-ended piston assembly to provide pressure-assist during each discharge stroke. In another form, one working end of each double-ended piston assembly can be uncoupled from the drilling fluid supply tank and instead coupled to the hydraulic pump thereby increasing the area against which the pressurized hydraulic fluid acts to correspondingly increase the pressure of drilling fluid discharged at the opposite working ends of the double-ended piston assemblies.

Other features and advantages of the present invention will become more apparent from the following detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figures 1, 2, 3:
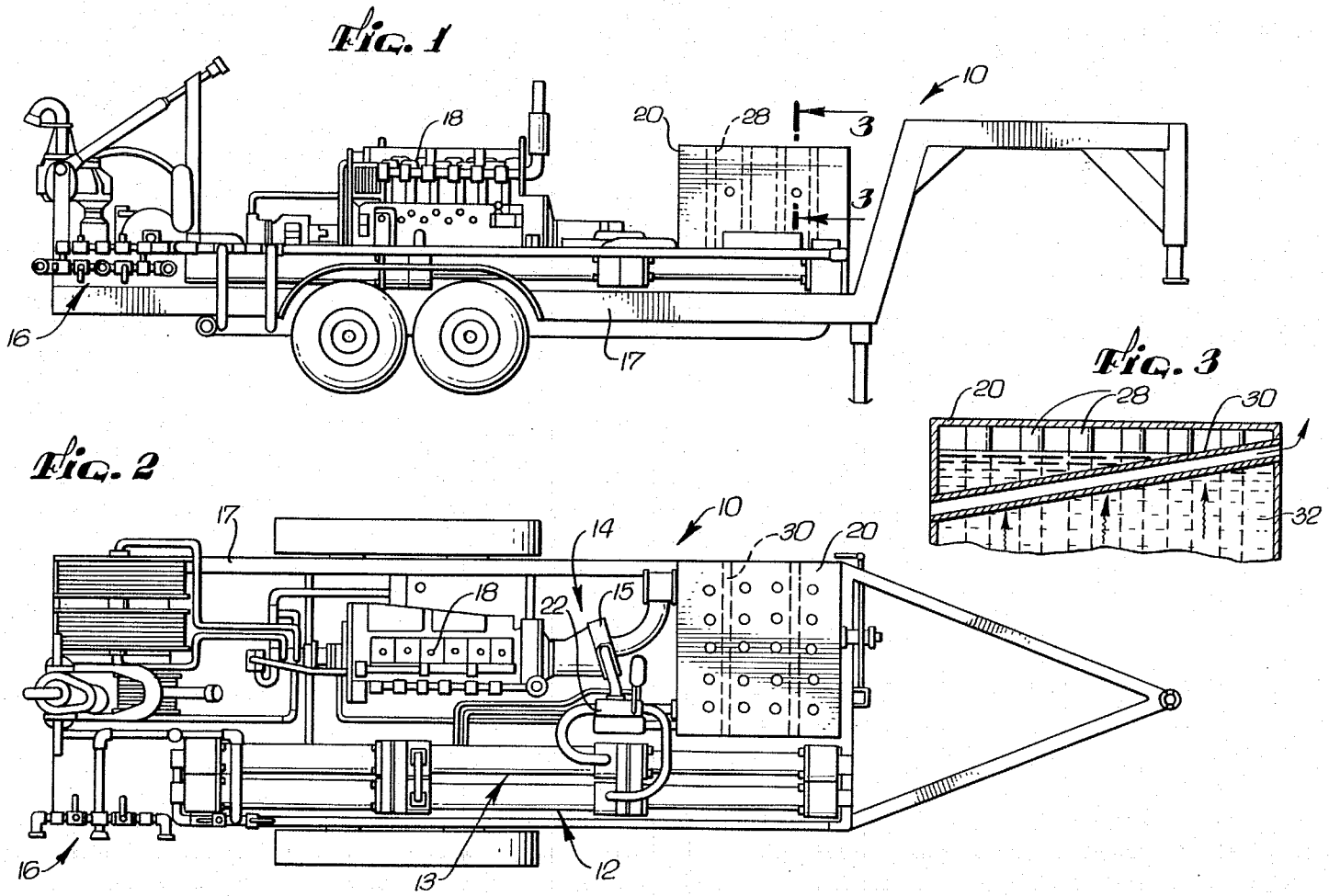
FIG. 1 is a side elevation view of a drilling fluid pump embodying the novel features of the present invention.
FIG. 2 is a top plan view of the drilling fluid pump shown in FIG. 1.
FIG. 3 is an enlarged fragmented vertical section taken generally on the line 3—3 of FIG. 1 and illustrating an hydraulic fluid reservoir for use in the drilling fluid pump of the present invention.

As shown in the exemplary drawings, an improved fluid drilling pump referred to generally by the reference numeral 10 is provided for pumping drilling fluid into a well (not shown) in conjunction with a well drilling or reworking procedure. The drilling fluid pump 10 comprises a pair of double-ended piston assemblies 12 and 13 which are driven together by an hydraulic drive arrangement or apparatus 14 including a high pressure hydraulic pump 15. The piston assemblies 12 and 13 are coupled to a supply of drilling fluid (not shown) in FIGS. 1–3) for drawing-in and discharging drilling fluid from pump cylinders, wherein a valving arrangement referred to generally bu the reference numeral 16 is provided to connect drilling fluid discharged from selected ones or all of the cylinders for supply to the well at selected different flow rates and pressures.

The present invention provides a substantial improvement upon previous drilling fluid pumps, sometimes referred to as mud pumps, for pumping drilling fluid under pressure into a well to lubricate operation of a drilling tool and to lift drilled earthen particulate from the well. This drilling fluid conventionally comprises a mixture of water and soil components, such as clay, together with selected drilling chemicals whereby the fluid has a relatively viscous nature typically with a substantial level of entrained solids. The solids constituents of the drilling fluid increases within the well as drilled earthern material is picked up by the fluid for flow to the surface whereat the drilling fluid is typically cycled to a settling pit or tank before return to the pump for recycling to the well. In operation, the pump must be capable of discharging drilling fluid at different substantially uniform flow rates and pressures, with maximum pressures up to several thousand psi, wherein the specific fluid flow rate and pressure is selected according to the particular drilling procedure being performed, such as reworking, fracturing, acidizing, cementing, etc. The present invention provides a drilling fluid pump of relatively simple design with minimum mechanical parts wherein the pump is capable of discharging drilling fluid at the desired different selected flow rates and pressures, all without permitting settling or solidification of drilling fluid within any portion of the pump which would otherwise adversely affect pump operation.

As shown in FIGS. 1–3, the improved drilling fluid pump 10 of the present invention is preferably installed upon a portable wheeled trailer adapted for facilitated transport to a well site. The trailer 17 provides a sturdy support frame for a plurality of the double-ended piston assemblies, with two piston assemblies 12 and 13 being shown in FIG. 2, together with the hydraulic drive apparatus 14 including the pump 15. The hydraulic pump 15 is driven by a trailer-mounted engine 18, such as a diesel engine, for drawing hydraulic fluid from a reservoir 20, also supported on the trailer 17. The hydraulic pump 15 discharges the fluid, typically a suitable hydraulic oil, at a relatively high pressure, such as on the order of about 5,000 psi to a distribution valve 22 which connects the high pressure hydraulic fluid and the reservoir 20 alternately and respectively with the two double-ended piston assemblies 12 and 13. Conveniently, the reservoir 20 comprises a generally closed container reinforced internally by vertically oriented air passage tubes 28 and transversely extending inclined air passage tube 30 through which ambient air flow is induced to cool the hydraulic fluid 32 (FIG. 3) contained therein.

Figure 4:
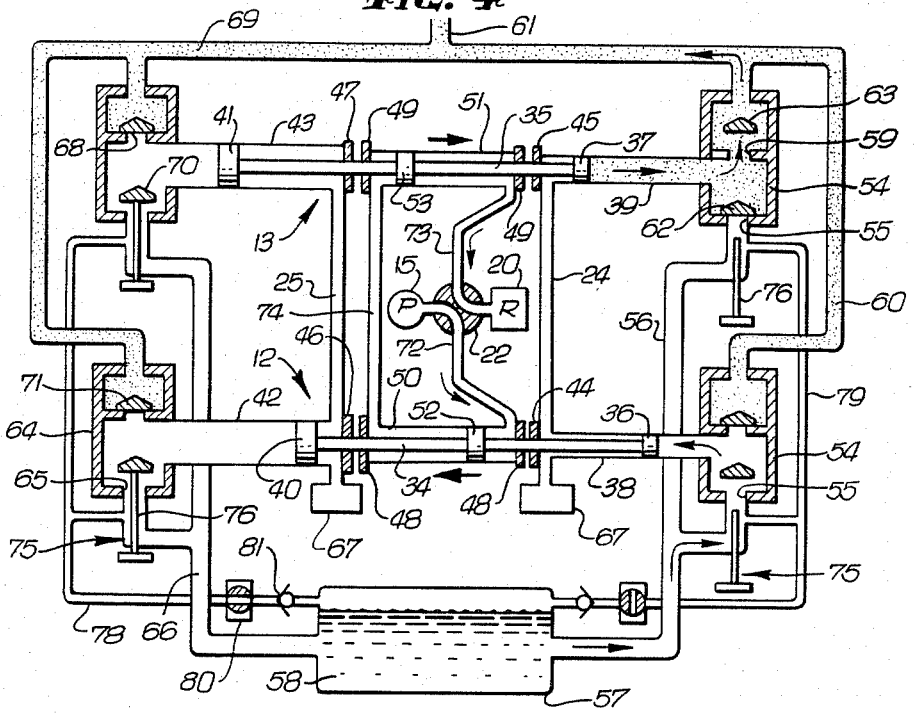
FIG. 4 is a schematic representation of one preferred form of the drilling fluid pump embodying the novel features of the present invention and illustrating the pump in one mode of operation for discharging drilling fluid at a relatively high pressure and low flow rate.
Figure 5:
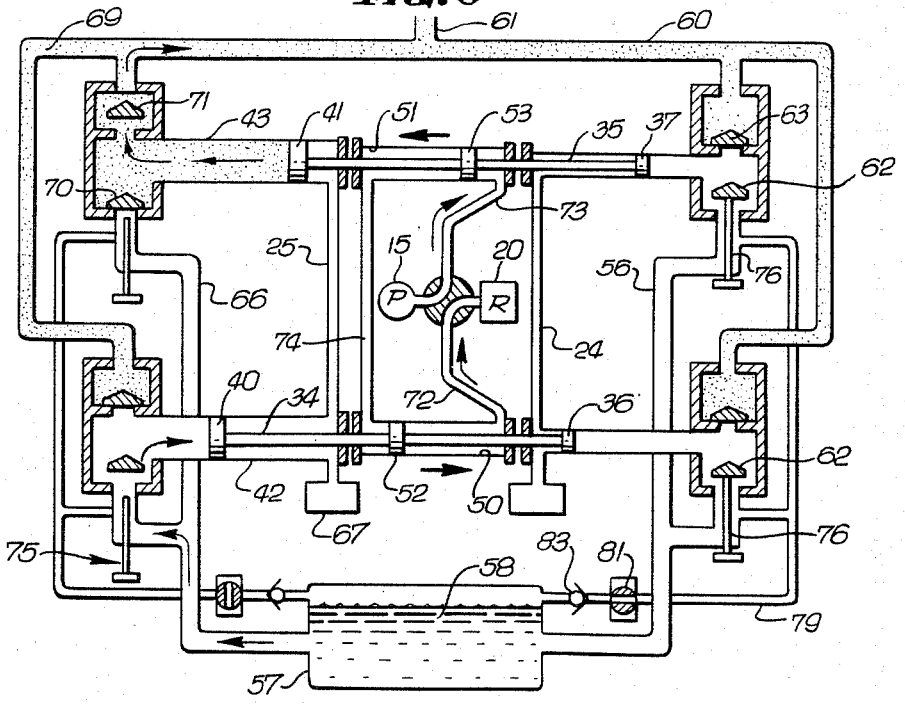
FIG. 5 is a schematic representation of the drilling fluid pump illustrated in FIG. 4 but showing the pump in an alternative mode of operation for discharging fluid at a comparatively higher pressure and lower flow rate.
Figure 6:
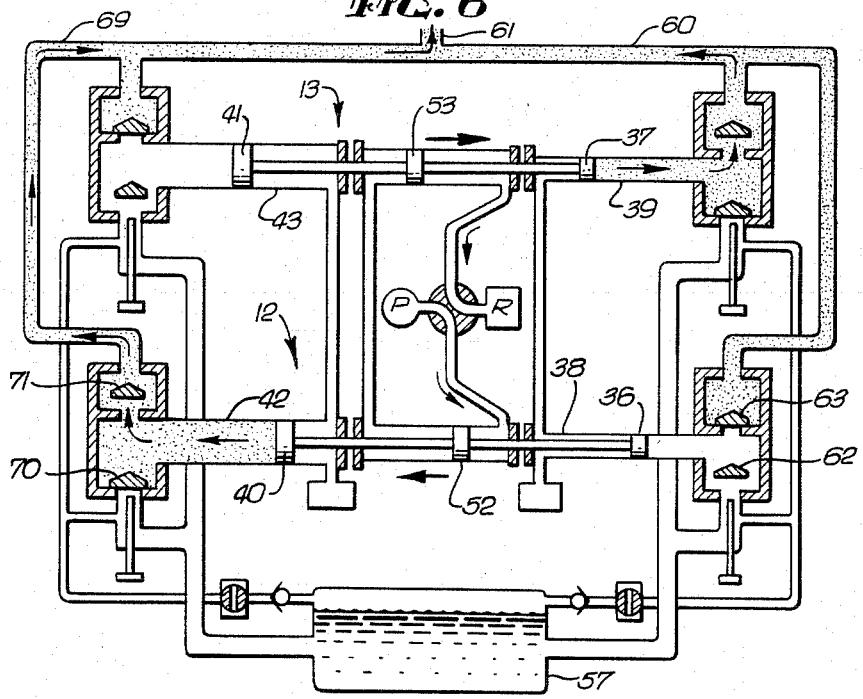
FIG. 6 is a schematic representation of the drilling fluid pump of FIG. 4 but illustrating the pump in a mode of operation for discharging drilling fluid at a relatively minimum pressure and otimum flow rate.

In accordance with one preferred form of the invention, as shown by the schematic representations of FIGS. 4–6, the double-ended piston assemblies 12 and 13 are generally identical with each other to include respectively an elongated piston rod 34 and 35 carrying at their opposite ends a relatively small piston 36 and 37 within appropriately sized cylinders 38 and 39, and a relatively large piston 40 and 41 within appropriately sized cylinders 42 and 43. These various cylinders 38, 42 and 39, 43 of the piston assemblies 12 and 13 have back-to-back generally closed ends defined by end walls 44, 46 and 45, 47 separated from adjacent end walls 48 and 49 of cylindrical hydraulic pressure chambers 50 and 51. Drive spools 52 and 53 are centrally positioned on the piston rods 34 and 35 within the pressure chambers 50 and 51 for driving interaction with the hydraulic pressurized fluid supplied by the hydraulic pump 15, as will be described in more detail.

The relatively small cylinders 38 and 39 of the two piston assemblies each have working ends opening into valve housings 54. These valve housings 54 have intake ports 55 coupled via a common intake conduit 56 to a supply tank 57 within which the drilling fluid 58 is contained. In addition, these valve housings have discharge ports 59 coupled through a common discharge conduit 60 to an outlet conduit 61 through which the drilling fluid 58 is dicharged to a well (not shown). Importantly, the intake ports 55 are selectively opened or closed by one-way intake valves 62 and the discharge ports 59 are selectively opened or closed by one-way discharge valves 63. Although these valves 62 and 63 are not shown in detail in the schematic drawings, conventional one-way spring-loaded poppet valves or the like are contemplated.

The comparatively larger cylinders 42 and 43 of the two piston assemblies 12 and 13 also include working ends opening into valve housings 64 each having intake ports 65 coupled through an intake conduit 66 to the fluid supply tank 57 and discharge ports 68 coupled through a common discharge conduit 69 to the outlet conduit 61. Similar to the valve housings 54 of the smaller cylinders 38 and 39, flow into and from these latter valve housings 64 is controlled by one-way intake valves 70 and one-way discharge valves 71 which may take the form of conventional spring-loaded poppet valves or the like.

The drilling fluid 58 is drawn in and discharged by the double-ended piston assemblies 12 and 13 in response to the driving action of the hydraulic pump 15. More particularly, with exemplary reference to FIG. 4, the hydraulic pump 15 supplies pressurized hydraulic fluid to the distribution valve 22 which in turn couples the fluid for flow through a first pressure conduit 72 to one side of the drive spool 52 of the piston assembly 12. This causes the drive spool 52 to move the associated piston rod 34 in a direction advancing the larger piston 40 and retracting the smaller piston 36 to expel drilling fluid from the larger cylinder 42 and to draw in drilling fluid to the smaller cylinder 38. At the same time, a pilot hydraulic fluid on the opposite side of the drive spool is forced from the pressure chamber 50 through a cross-over conduit 74 to act against one side of the drive spool 53 of the other piston assembly 13. The pilot fluid thereby moves the other piston rod 35 in an opposite reciprocal direction relative to the piston rod 34 to correspondingly advance the associated smaller piston 37 while retracting the associated larger piston 41. Such movement, of course, is attended by appropriate intake of drilling fluid to the larger cylinder 43 and appropriate discharge of drilling fluid from the smaller cylinder 35. Hydraulic fluid on the side of the drive spool 53 opposite the pilot fluid is returned through a second conduit 73 to the distribution valve 22 which in turn couples that fluid for return flow to the reservoir 20.

At the conclusion of opposite reciprocal stokes described with respect to FIG. 4, the distribution valve 22 is positionally adjusted to connect the hydraulic pump 15 to the second conduit 73 and the reservoir 20 to the first conduit 72. This reversal of distribution valve position thus supplies the hydraulic fluid to the piston assembly 13 for effecting an opposite reciprocating motion resulting in a corresponding reversal of pilot fluid movement to act against the drive spool 50 of the piston assembly 12. Hydraulic fluid within the pressure chamber 50 of the piston assembly 12 is recycled through the distribution valve 22 to the reservoir 20 until the completion of the reverse reciprocation at which time the distribution valve switches state again to reciprocate the piston assemblies in opposite directions. Distribution valve switching may be in response to any suitable parameter, such as, for example, response to detection switches (not shown) for detecting completion of piston rod strokes.

During the above-described opposite reciprocation of the piston assemblies 12 and 13, build-up of grit and other contaminants on the inner surfaces of the various cylinders 38, 39 and 42, 43 is minimized by the cleansing action of a cleaning fluid in the space between each piston 36, 37 and 40, 41 and the respective end wall 44–47. This cleaning fluid, which may comprise a light-weight oil, water, or the like is not placed under pressure but instead is allowed to flow back and forth between the cylinders 38 and 39 through a crossover duct 24 and between the cylinders 42 and 43 through a cross-over duct 25. Conveniently, these cross-over ducts 24 and 25 communicate with respective sumps 67 into which particulate contaminants washed from the cylinders is allowed to settle for periodic clean out. Moreover, cross leakage of cleaning fluid with the hydraulic fluid in the pressure chambers 50 and 51 is prevented by the split or separated nature of the various end walls 44–47 and 48, 49.

In accordance with a primary feature of the invention, appropriate control of the one-way intakes valve 62 and 70 provides a relatively simple and convenient means for controlling the output flow rate and pressure of drilling fluid from the pump. More particularly, with reference to FIGS. 4–6, an override mechanism 75 in the form of a hand-operated plunger 76 or the like is associated with each intake valve 62 and 70 and selectively operable to hold the intake valve in an open position, thereby overriding normal intake valve opening and closing movement in response to reciprocation of the associated piston.

For example, as shown in FIG. 4, the override plunger 76 associated with the intake valve 70 at the working ends of the larger pistons 40 and 41 are set to hold those intake valves in open positions. In this setting, retraction of the larger pistons 40 and 41 within the associated cylinders 42 and 42 normally affects drawing-in of the drilling fluid from the supply tank 57. However, extension of advancing movement of the larger pistons 40 and 41 is ineffective to open the associated discharge valve 71, but instead, the drilling fluid is expelled with little resistance through the open intake valve 70 for return circulation to the supply tank 57. Accordingly, in this set mode, the larger pistons 40 and 41 of the two piston assemblies do not discharge drilling fluid to the discharge conduit 69. Instead, the larger pistons 40 and 41 merely recirculate the drilling fluid to and from the supply tank.

The intake valve 62 associated with the smaller pistons 36 and 37, however, are allowed to open and close normally thereby permitting drawing-in of drilling fluid upon piston retraction. When the smaller pistons 36 and 37 are extended, as shown with respect to the upper piston assembly 13 in FIG. 4, the drilling fluid within the smaller cylinders is compressed to close the associated intake valve 62 and open the discharge valve 63 for passage of the drilling fluid under pressure into the discharge conduit 60. Accordingly, drilling fluid discharge in this set mode is limited to that drilling fluid discharged by the smaller pistons 36 and 37 whereby fluid is pumped to the well at a relatively high pressure and relatively low flow rate. Backpressure present in the discharge conduit 60 maintains sufficient back pressure through the discharge conduit 69 to act upon the discharge valve 71 associated with the larger pistons 40 and 41 to prevent opening thereof. In addition, stagnation of drilling fluid within the intake conduit 66 associated with the larger pistons is prevented by auxiliary return conduits 78 which permit additional flow from the cylinders 42 and 43 through a manually set open valve 80 and a one-way check valve 81 to the supply tank 57.

The drilling fluid pump may be set quickly and easily in an alternative operational mode for discharging drilling fluid to the well at a comparatively higher flow rate and somewhat lower pressure by retracting the override plungers 76 from the intake valve 70 associated with the larger pistons 40 and 41 and advancing the override plungers 76 associated with the intake valves 62 at the working ends of the smaller pistons 36 and 37. This couples the smaller pistons 36 and 37 during reciprocation for drawing-in and discharge of drilling fluid through the intake conduit 56 thereby recycling this drilling fluid to the supply tank 57. However, the intake valves 70 at the working ends of the larger pistons 40 and 41 are allowed to operate in a conventional manner for drawing-in of drilling fluid upon retraction of the pistons 40 and 41 and to close upon piston extension whereby drilling fluid is discharged under pressure through the one-way discharge valves 68 to the discharge conduit 69. As a result, by virtue of the comparatively larger cross-sectional areas of the pistons 40 and 41, a relatively higher flow rate of drilling fluid is supplied to the well at a relatively lower pressure. Conveniently, in this set mode, fluid stagnation within the intake conduit 56 associated with the smaller pistons 36 and 37 is prevented by auxiliary return conduits 79 which permit additional fluid flow from the cylinders 38 and 39 through a manually set open valve 81 (FIG. 5) and a one-way check valve 83 to the supply tank 57.

A third mode of operation for the drilling fluid pump 10 of this invention is depicted in FIG. 6 wherein all of the override plungers 76 are retracted to permit normal opening and closing movement of the one-way intake valves 62 and 70. In this set mode of operation, the larger pistons 40, 41 and the smaller pistons 36, 37 all function to draw in drilling fluid from the respective intake conduits 56 and 66 and to discharge that drilling fluid under pressure through the respective discharge conduits 60 and 69 to the outlet conduit 61. At any one time, fluid is discharged simultaneously by one of the larger pistons and one of the smaller pistons resulting in an overall increased piston surface area acting to discharge drilling fluid to provide a maximum fluid flow rate but at a lower pressure. In this mode of operation, the valves 80 and 81 along the auxiliary return conduit 78 and 79 are closed.

The above-described drilling fluid pump 10 is thus quickly and easily set in any one of three different modes of operation to provide drilling fluid discharge at different selected flow rates and pressures. This versatility can be particularly advantageous, such as, for example, when it is desired to initiate a drilling procedure at a relatively low fluid pressure, but to increase that fluid pressure as the procedure progresses. Importantly, however, irrespective of the mode of pump operation, all of the pump pistons draw in and expel drilling fluid at all times. Accordingly, motionless drilling fluid within the pump cylinders is avoided to correspondingly avoid settling of particulate or solidification of the drilling fluid within the cylinders which would otherwise clog or prevent subsequent reciprocation of the piston assemblies.

Figure 7:
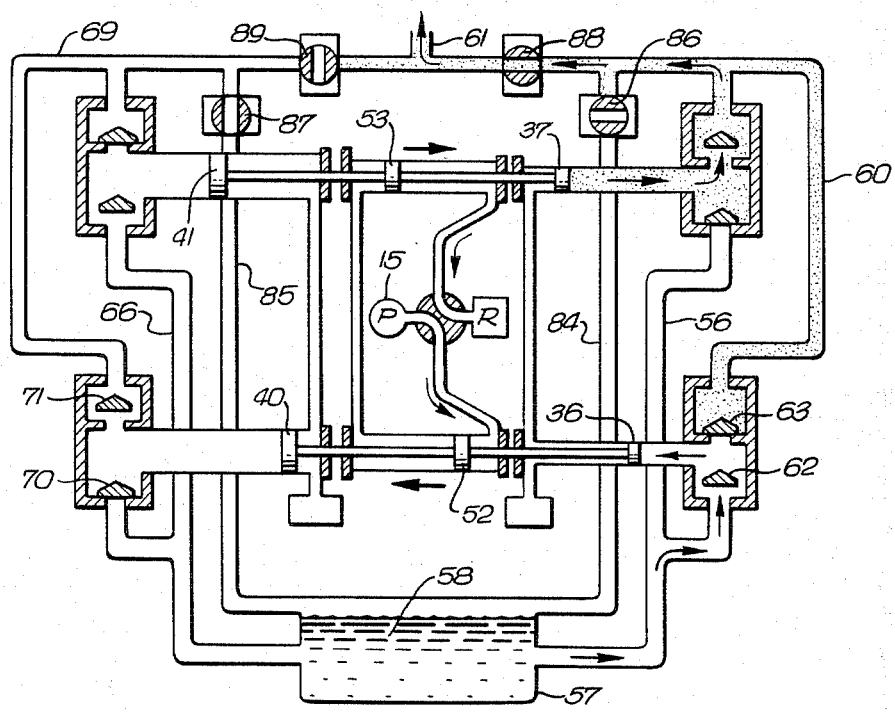
FIG. 7 is a schematic representation illustrating an alternative preferred form of the drilling fluid pump of the present invention.

An alternative form of the invention is shown in FIG. 7 wherein components identical with those illustrated in FIGS. 4–6 are referred to by common reference numerals. In this embodiment, the intake valve override mechanisms 75 are removed and replaced by additional recycle conduits and associated flow control valves for permitting pump operation in the three different modes described with respect to FIGS. 4–6. More particularly, a recycle conduit 84 is coupled between the supply tank 57 and the discharge conduit 60 at a point slightly upstream from the outlet conduit 61. Similarly, a second recycle conduit 85 is coupled between the tank 57 and the discharge conduit 69 at a position slightly upstream from the outlet conduit 61. Each recycle conduit 84 and 85 includes along its length a flow control valve 86 and 87, respectively, with additional flow control valves 88 and 89 being provided along the discharge conduits 60 and 69 between the recycle conduits and the outlet conduit 61.

The particular mode of operation of the alternative pump arrangement shown in FIG. 7 is controlled by appropriate setting of the flow control valves 86–89. In one mode, as illustrated in FIG. 7, the flow control valve 87 along the recycle conduit 85 is opened, whereas the flow control valve 86 along the recycle conduit 84 is closed. In addition, the flow control valve 88 is opened to permit flow of drilling fluid from the discharge conduit 60 to the outlet conduit 61, while the remaining flow control valve 89 is closed. In this set mode of operation, drilling fluid discharged into the discharge conduit 69 by the larger pistons 40 and 41 is recycled through the recycle conduit 85 to the supply tank 57. However, drilling fluid discharged by the smaller pistons 36 and 37 is coupled to the outlet conduit to supply drilling fluid to the well at a relatively high pressure and low flow rate.

A comparatively higher flow rate with somewhat lower pressure is achieved in the pump arrangement of FIG. 7 by reversing the setting of each flow control valve 86–89. Such reversal recycles drilling fluid discharged by the smaller pistons 36 and 37 to the supply tank 57 but permits drilling fluid discharged by the larger pistons 40 and 41 to flow to the outlet conduit. Similarly, a further increased flow rate with a corresponding pressure decrease may be obtained by closing both flow control valves 86 and 87 along the recycle conduits 84 and 85 while opening both flow control valves along the discharge conduits 60 and 69. Such valve settings permit operation in the same manner as described with respect to FIG. 6.

Figure 8:
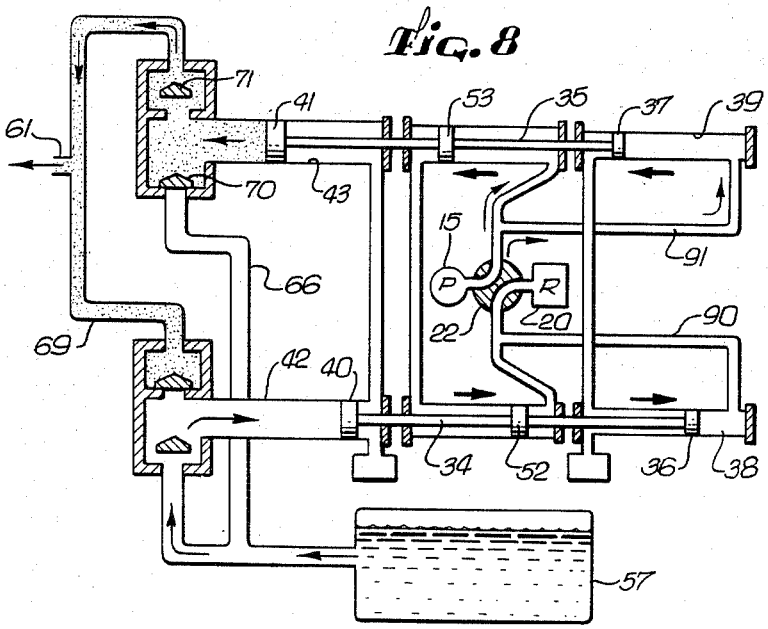
FIG. 8 is a schematic representation illustrating a further alternative form of the drilling fluid pump of the present invention.
Figure 9:
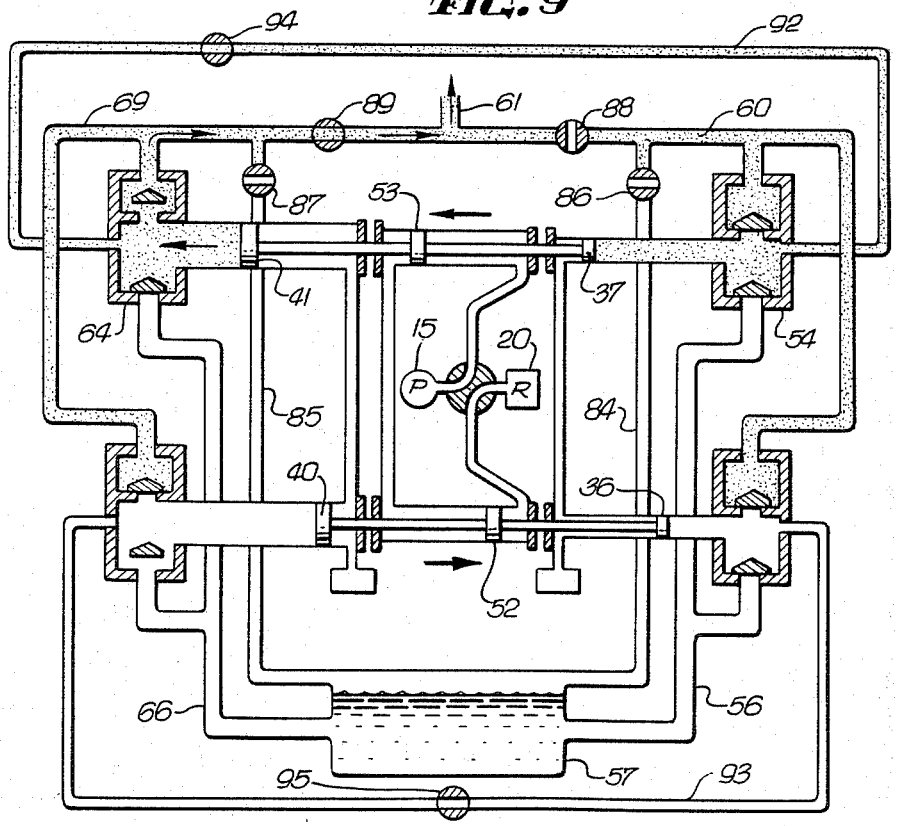
FIG. 9 is a schematic representation of another alternative form of the drilling fluid pump of the present invention.

Further modification of the drilling fluid pump of the present invention is illustrated in FIGS. 8 and 9 to obtain increased drilling fluid discharge pressures in applications wherein extremely high fluid pressure is required. For example, with reference to FIG. 8, the working ends of the smaller cylinders 38 and 39 can be disconnected from their associated valve housings 54 (FIGS. 4–6) and instead capped and coupled through pressure conduits 90 and 91 to the conduits 72 and 73 connected to the distribution valve 22. With this arrangement, the distribution valve 22 alternately and respectively connects the hydraulic pump 15 and the reservoir 20 to the two pistons assemblies for opposite reciprocal driving of the piston rods 34 and 35 and their associated pistons. However, for each power stroke, the pressurized hydraulic fluid supplied from the pump 15 acts against the surface area of the drive spool 52, 53 as well as the surface area of the associated smaller piston 36, 37. The total surface area against which the pressurized hydraulic fluid acts is thus substantially increased, thereby resulting in a corresponding substantial increase in overall driving force during each power stroke. This increased driving force directly results in an increased pressure of the drilling fluid discharged by the larger piston 40 and 41. If further increased drilling fluid discharge pressure is desired, the pump can be modified in a reverse manner to that shown in FIG. 8 to supply hydraulic fluid additionally to the working ends of the larger cylinders 42 and 43 while permitting the smaller pistons 36 and 37 to pump drilling fluid through the outlet conduit 61 to the well.

An alternative pressure intensifier arrangement is shown in FIG. 9 wherein the illustrative system is generally the same as that depicted in FIG. 7 with the addition of intensifier conduits 92 and 93 connected between the valve housings 54 and 64 of each double-ended piston assembly, respectively. Each intensifier conduit 92 and 93 includes a flow control valve 94 and 95 which, when opened, permits intensification of drilling fluid discharge pressure.

For example, as shown in FIG. 9, the flow control valves 86 and 87 along the recycle conduits 84 and 85 are closed. In addition, the flow control valve 88 along the discharge conduit 60 is closed, whereas the flow control valve 89 along the discharge conduit 69 is opened. In this setting, drilling fluid discharged by the larger pistons 40 and 41 is permitted to flow through the discharge conduit 69 to the outlet conduit 61, whereas drilling fluid discharged by the smaller pistons 36 and 37 is limited to flow through the associated intensifier conduit 92 or 93. Accordingly, the pressure of drilling fluid discharged by the smaller pistons acts through the intensifier conduits to assist in driving operation of the larger pistons thereby increasing the driving force acting on the larger pistons and correspondingly increasing the pressure of drilling fluid discharged thereby.

Alternative flow control valve settings in the embodiment of FIG. 9 may be used to achieve alternative levels of fluid pressure intensification. For example, the flow control valves 88 and 89 along the discharge conduits 60 and 69 may be reversed in position such that drilling fluid discharged by the smaller pistons is permitted to flow to the outlet conduit. In this setting mode, drilling fluid discharged by the larger pistons 40 and 41 is limited to flow through the intensifier conduit 92 and 93 for assisting in driving the smaller pistons. Conveniently, the embodiment of FIG. 9 may be operated in a conventional manner as described above with respect to FIG. 7 by closure of the intensifier conduit valves 94 and 95 and appropriate setting of the flow control valves 86–89.

The improved drilling fluid pump 10 of the present invention thus provides a highly versatile yet relatively simplified pump construction of a relatively small number of moving parts for providing drilling fluid outputs at selected pressures and flow rates. The pump is quickly and easily switched from one operational mode to another to secure the output fluid pressure and flow rate desired, while advantageously circulating drilling fluid through all pump cylinders during all conditions of operation to prevent fluid settling or solidification. The pump advantageously permits the use of relatively long piston strokes, such as on the order of three to four feet, to provide a highly uniform drilling fluid discharge which, by virtue of the opposite reciprocation of the piston assemblies, is maintained substantially uniform during all conditions of operation without significant pressure surges or flow rate variations. The speed of pistons assembly stroke can be selected as desired, but preferably comprises a relatively slow speed to minimize wear on pump components. Moreover, the comparative sizes of the smaller and larger pistons can be selected as needed to provide the desired drilling fluid discharge pressure levels.

Further modifications and improvements to the drilling fluid pump described herein are believed to be apparent to one of ordinary skill in the art. Accordingly, no limitation on the invention is intended, except by way of the appended claims.

What is claimed is:

1. A pump for pumping a relatively viscous working fluid from a supply tank to an outlet conduit, comprising:

a pair of double-ended piston assemblies each including a pair of generally back-to-back cylinders of different cross-sectional size and a reciprocal piston rod having a pair of appropriately sized pistons generally at opposite ends thereof and received respectively within said cylinders;

each of said piston assemblies further including a pressure chamber disposed centrally between said pair of cylinders and a drive spool on said piston rod reciprocally within said pressure chamber;

hydraulic drive means including a reservoir of hydraulic fluid, a pump for supplying the hydraulic fluid at a relatively high pressure, a first conduit coupled to said pressure chamber of one of said piston assemblies at one side of the associated drive spool, a second conduit coupled to said pressure chamber of the other of said piston assemblies at one side of the associated drive spool, distribution valve means for alternately and respectively connecting said first and second conduits to said pump and said reservoir, a cross-over duct connected between said pressure chambers of said piston assemblies at the other sides of said drive spools, and a pilot fluid within said cross-over duct and pressure chambers at the other sides of said drive spools, whereby alternate supply of the pressurized hydraulic fluid to said first and second conduits reciprocally drives said piston rods of said piston assemblies together to retract and extend said pistons within said cylinders;

an intake conduit coupled between the supply tank and one of said cylinders of each of said piston assemblies;

one-way intake valve means for permitting drawing-in of the working fluid into said cylinders coupled to said intake conduit upon retraction of the associated pistons;

one-way discharge valve means for permitting discharge of the drawn-in working fluid to the outlet conduit; and a pair of pressure conduits coupled respectively between said first and second conduits and the other of said cylinders of said piston assemblies for alternately and respectively coupling said other cylinders to said pump and said reservoir.

2. A pump for pumping a working fluid from a supply tank to an outlet conduit, comprising:

a pair of double-ended piston assemblies, each including a pair of generally back-to-back cylinders and a reciprocal piston rod having a pair of pistons received respectively within said cylinders;

drive means for simultaneously reciprocating said piston rods of said piston assemblies, to reciprocate said pistons within their respective cylinders;

an intake conduit coupled to the supply tank;

flow control means including intake means for coupling all of said cylinders to said intake conduit upon retraction of their respective pistons, to draw in the working fluid from the supply tank, said intake means including a one-way intake valve for each of said cylinders, for controlling intake of the fluid from said intake conduit, and discharge means selectively operable for coupling said cylinders upon extension of their respective pistons to discharge the drawn-in working fluid to either the outlet conduit or the supply tank, with at least one of said cylinders of each of said piston assemblies being coupled to the outlet conduit, said discharge means including a one-way discharge valve for each of said cylinders, for controlling discharge of the working fluid to the outlet conduit, and an override mechanism for each of said intake valves, for retaining selected ones of said intake valves in a locked-upon position, whereby the working fluid dicharged from the associated cylinders is recycled through said locked-open intake valves and further through said intake conduit to the supply tank; and an auxiliary return conduit coupled between said intake conduit adjacent each of said locked-open intake valves and the supply tank, said auxiliary return conduit including valve apparatus along the length thereof, for selectively controlling flow of the working fluid therethrough.

3. A pump for pumping a working fluid from a supply tank to an outlet conduit, comprising:

a pair of double-ended piston assemblies, each including a pair of generally back-to-back cylinders and a reciprocal piston rod having a pair of pistons received respectively within said cylinders;

drive means for simultaneously reciprocating said piston rods of said piston assemblies, to reciprocate said pistons within their respective cylinders;

an intake conduit coupled to the supply tank;

flow control means including intake means for coupling all of said cylinders to said intake conduit upon retraction of their respective pistons, to draw in the working fluid from the supply tank, said intake means including a one-way intake valve for each of said cylinders, for controlling intake of the fluid from said intake conduit, and discharge means selectively operable for coupling said cylinders upon extension of their respective pistons, to discharge the drawn-in working fluid to either the outlet conduit or the supply tank, with at least one of said cylinders of each of said piston assemblies being coupled to the outlet conduit, said discharge means including a discharge conduit coupled between each of said cylinders and the outlet conduit, a one-way discharge valve for each of said cylinders, for controlling discharge of the working fluid through the discharge conduit to the outlet conduit, a recycle conduit coupled between said discharge conduit and the supply tank, and flow control valve means selectively operable for coupling the working fluid discharged from said cylinders to either said recycle conduit or the outlet conduit; and an intensifier conduit coupled between said pair of cylinders of each of said piston assemblies and a valve member for selectively opening and closing said intensifier conduit to flow of the working fluid therethrough, said flow control valve means being selectively operable for coupling the working fluid discharged from one of said cylinders of each piston assembly to the outlet conduit and to the other of said piston assembly cylinders, and for coupling the working fluid discharged from the other of said piston assembly cylinders to said one piston assembly cylinder.

4. A pump for pumping a relatively viscous working fluid from a supply tank to an outlet conduit, comprising:

a pair of double-ended piston assemblies, each including a pair of generally back-to-back cylinders of different cross-sectional size and a reciprocal piston rod having a pair of appropriately-sized pistons generally at opposite ends thereof and received respectively within said cylinders;

hydraulic drive means for simultaneously reciprocally driving said piston rods of said piston assemblies, to reciprocate said pistons within their respective cylinders;

an intake conduit coupled to the supply tank;

a plurality of one-way intake valves, each associated with a respective one of said cylinders and normally operable to open upon retraction of said piston within said associated cylinder, to permit drawing-in of the working fluid from the supply tank;

a first discharge conduit coupled between the outlet conduit and the larger ones of said cylinders of said piston assemblies;

a second discharge conduit coupled between the smaller ones of said cylinders of said piston assemblies;

a plurality of one-way discharge valves, each associated with a respective one of said cylinders and operable to open upon extension of said piston within said associated cylinder, to permit discharge of the drawn-in working fluid to the associated one of said first and second discharge conduits;

recycle conduit means coupled between the supply tank and first and second discharge conduits;

flow control valve means for selectively coupling the working fluid discharged to said first discharge conduit selectively to either the outlet conduit or said recycle conduit means and for selectively coupling the working fluid discharged to said second discharge conduit selectively to either the outlet conduit or said recycle conduit means; and an intensifier conduit coupled between said pair of cylinders of each of said piston assemblies and a valve member for selectively opening and closing said intensifier conduit to flow of the working fluid therethrough, said flow control valve means being selectively operable for coupling the working fluid discharged from one of said cylinders of each piston assembly to the outlet conduit and to the other of said piston assembly cylinders, and for coupling the working fluid discharged from the other of said piston assembly cylinders to said one piston assembly cylinder.

5. A pump for pumping a relatively viscous working fluid from a supply tank to an outlet conduit, comprising:

a pair of double-ended piston assemblies, each including first and second generally back-to-back cylinders of different cross-sectional size and a reciprocal piston rod having first and second appropriately-sized pistons generally at opposite ends thereof and received respectively within said first and second cylinders;

hydraulic drive means for simultaneously reciprocally driving said piston rods of said piston assemblies, to reciprocate said pistons within their respective cylinders;

an intake conduit coupled to the supply tank;

a plurality of one-way intake valves, each associated with a respective one of said cylinders and normally operable to open upon retraction of said piston within said associated cylinder, to permit drawing-in of the working fluid from the supply tank;

a first discharge conduit coupled between the outlet conduit and the larger ones of said cylinders of said piston assemblies;

a second discharge conduit coupled between the outlet conduit and the smaller ones of said cylinders of said piston assemblies;

a plurality of one-way discharge valves, each associated with a respective one of said cylinders and operable to open upon extension of said piston within said associated cylinder, to permit discharge of the drawn-in working fluid to the associated one of said first and second discharge conduits;

recycle conduit means coupled between the supply tank and the first and second discharge conduits; and flow control valve means for selectively coupling the working fluid discharged to said first discharge conduit selectively to either the outlet conduit or said recycle conduit means and for selectively coupling the working fluid discharged to said second discharge conduit selectively to either the outlet conduit or said recycle conduit means;

wherein said pair of piston assemblies are sized and configured such that the first pistons in said assemblies cooperate to provide a first uniform pressure and flow rate, and such that the second pistons in said assemblies cooperate to provide a second uniform pressure and flow rate, whereby the working fluid discharged to the outlet conduit is substantially free of any cyclic pressure and flow rate variations as said pistons reciprocate in their associated cylinders.

6. The pump of claim 5 wherein said recycle conduit means comprises a first recycle conduit coupled between said first discharge conduit and the supply tank and a second recycle conduit coupled between said second discharge conduit and the supply tank.

7. A pump for pumping a relatively viscous working fluid from a supply tank to an outlet conduit, comprising:

a pair of double-ended piston assemblies, each including first and second generally back-to-back cylinders of different cross-sectional size and a reciprocal piston rod having first and second appropriately-sized pistons generally at opposite ends thereof and received respectively within said first and second cylinders;

hydraulic drive means for simultaneously reciprocally driving said piston rods of said piston assemblies, to reciprocate said pistons within their respective cylinders;

an intake conduit coupled to the supply tank;

a plurality of one-way intake valves, each associated with a respective one of said cylinders and normally operable to open upon retraction of said piston within said associated cylinder, to permit drawing-in of the working fluid from the supply tank;

a plurality of one-way discharge valves, each associated with a respective one of said cylinders and normally operable to open upon extension of said piston within said associated cylinder, to permit discharge of the drawn-in working fluid to the outlet conduit; and means for selectively retaining selected ones of said intake valves in an open position throughout retraction and extension of said pistons within said associated cylinders, to permit discharge of the drawn-in working fluid through said intake conduit to the supply tank, wherein said pair of piston assemblies are sized and configured such that the first pistons in said assemblies cooperate to provide a first uniform pressure and flow rate, and such that the second pistons in said assemblies cooperate to provide a second uniform pressure and flow rate, whereby the working fluid discharged to the outlet conduit is substantially free of any cyclic pressure and flow rate variations as said pistons reciprocate in their associated cylinders.

8. The pump of claim 7 wherein said retaining means is selectively operable in a first mode for retaining said intake valves associated with the smaller cylinders of said piston assemblies in an open position and for permitting normal operation of said intake valves associated with the larger cylinders of said piston assemblies, a second mode for retaining said intake valves associated with said larger cylinders in an open position and for permitting normal operation of said intake valves associated with said smaller pistons, and a third mode permitting normal operation of all of said intake valves.

9. The pump of claim 7 wherein each of said piston assemblies includes a drive spool on said piston rod and means forming a pressure chamber within which said drive spool is disposed, said drive means including an hydraulic fluid reservoir, an hydraulic pump for pumping hydraulic fluid from said reservoir at a relatively high pressure, distribution valve means for alternately and respectively coupling said pump and reservoir to said piston assembly pressure chambers at one side of said piston assembly drive spools, a cross-over conduit coupled between said piston assembly pressure chambers at the other sides of said piston assembly drive spools, and a pilot fluid within said cross-over conduit and said pressure chambers at the other sides of said drive spools.

10. A method of pumping a working fluid from a supply tank to an outlet conduit, comprising the steps of:

providing a pair of double-ended piston assemblies, each including first and second generally back-to-back cylinders and a reciprocal piston rod having first and second appropriately-sized pistons generally at opposite ends thereof and received respectively within said first and second cylinders, said first cylinders and corresponding first pistons being of a first size, and said second cylinders and corresponding second pistons being of a second, different size;

reciprocally driving the pistons together for simultaneous extension and retraction of the larger pistons of the two piston assemblies and for simultaneous extension and retraction of the smaller pistons of the two piston assemblies;

coupling each of the cylinders to the supply tank for drawing-in of the working fluid upon retraction of the associated pistons; and selectively coupling the cylinders upon extension of their associated pistons to either the supply tank or the outlet conduit, for discharge of the drawn-in working fluid selectively to the supply tank and outlet conduit;

wherein said pair of piston assemblies are sized and configured such that the first pistons in said assemblies cooperate to provide a first uniform pressure and flow rate, and such that the second piston in said assemblies cooperate to provide a second uniform pressure and flow rate, whereby the working fluid discharged to the outlet conduit is substantially free of any cyclic pressure and flow rate variations as said pistons reciprocate in their associated cylinders.

11. The method of claim 10 wherein said selective coupling step comprises coupling the larger cylinders of the piston assemblies to the outlet conduit and the smaller cylinders to the supply tank.

12. The method of claim 10 wherein said selective coupling step comprises coupling the smaller cylinders of the piston assemblies to the outlet conduit and the larger cylinders to the supply tank.

13. The method of claim 10 wherein said selective coupling step comprises coupling all of the cylinders to the outlet conduit.

14. A pump for pumping a working fluid from a supply tank to an outlet conduit, comprising:

a pair of double-ended piston assemblies, each including first and second generally back-to-back cylinders and a reciprocal piston rod having first and second pistons received respectively within said first and second cylinders, said first cylinders and corresponding first pistons being of a first size, and said second cylinders and corresponding second pistons being of a second, different size;

drive means for simultaneously reciprocating said piston rods of said piston assemblies, to reciprocate said pistons within their respective cylinders;

an intake conduit coupled to the supply tank; and flow control means including intake means for coupling all of said cylinders to said intake conduit upon retraction of their respective pistons, to draw in the working fluid from the supply tank, and discharge means selectively operable for coupling said first cylinders of said piston assemblies upon extension of their respective corresponding pistons, to discharge the drawn-in working fluid to either the outlet conduit or the supply tank, and further selectively operable for coupling said second cylinders of said piston assemblies upon extension of their corresponding pistons, to discharge the drawn-in working fluid to either the outlet conduit or the supply tank, with at least said first cylinders or said second cylinders being coupled to the outlet conduit;

wherein said pair of piston assemblies are sized and configured such that the first pistons in said assemblies cooperate to provide a first uniform pressure and flow rate and such that the second pistons in said assemblies cooperate to provide a second uniform pressure and flow rate, whereby the working fluid discharged to the outlet conduit is substantially free of any cyclic pressure and flow rate variations as said pistons reciprocate in their associated cylinders.

15. The pump of claim 14 wherein said discharge means is selectively operable in a first mode to couple the working fluid discharged from all of said cylinders to the outlet conduit, a second mode to couple a first cylinder of each of said piston assemblies to the outlet conduit and a second cylinder of each of said piston assemblies to the supply tank, and a third mode to couple the second cylinders to the outlet conduit and the first cylinders to the supply tank.

16. The pump of claim 14 wherein the working fluid comprises a well drilling fluid.

17. The pump of claim 14 wherein the working fluid comprises a relaively viscous fluid.

18. The pump of claim 14 wherein said drive means comprises hydraulic drive means for reciprocally driving said piston rods of said piston assemblies in opposite directions.

19. The pump of claim 18 wherein each of said cylinders includes a cleaning fluid on the side of their respective pistons opposite the working fluid, and further including a cross-over duct coupled between a pair of said cylinders having their respective pistons simultaneously retracting and extending.

20. The pump of claim 19 wherein each of said cross-over ducts is in communication with a settling sump.

21. The pump of claim 14 wherein each of said piston assemblies includes a drive spool on said piston rod and means forming a pressure chamber within which said drive spool is disposed, said drive means including an hydraulic fluid reservoir, an hydraulic pump for pumping hydraulic fluid from said reservoir at a relatively high pressure, distribution valve means for alternately and respectively coupling said pump and reservoir to said piston assembly pressure chambers at one side of said piston assembly drive spools, a cross-over conduit coupled between said piston assembly pressure chambers at the other sides of said piston assembly drive spools, and a pilot fluid within said cross-over conduit and said pressure chambers at the other sides of said drive spools.

22. The pump of claim 21 wherein said reservoir comprises an hydraulic fluid container having a plurality of tubes extending therethrough and defining air flow passages with at least some vertical component of direction.

23. The pump of claim 21 wherein said cylinders of each of said piston assemblies have end walls at their ends adjacent the associated pressure chamber, said pressure chamber being defined in part by end walls separated from said cylinder end walls.

24. The pump of claim 14 wherein said intake means comprises a one-way intake valve for each of said cylinders for controlling intake of the fluid from said intake conduit and said discharge means comprises a one-way discharge valve for each of said cylinders for controlling discharge of the working fluid to the outlet conduit.

25. The pump of claim 24 wherein said discharge means further includes an override mechanism for each of said intake valves for retaining selected ones of said intake valves in a locked-open position whereby the working fluid discharged from the associated cylinders is recycled through said locked-open ones of said intake valves and further through said intake conduit to the supply tank.

26. The pump of claim 24 including a discharge conduit coupled between each of said cylinders for receiving the fluid discharged therefrom and the outlet conduit, said discharge means further including a recycle conduit coupled between said discharge conduit and the supply tank, and flow control valve means selectively operable for coupling the working fluid discharged from said cylinders to one of said recycle conduit and the outlet conduit.

* * * * *